US005419497A

United States Patent [19]

Warrington

[11] Patent Number: 5,419,497

[45] Date of Patent: May 30, 1995

[54] PORTABLE PUMPING STATION

[76] Inventor: Bruce Warrington, 32742 Alipaz #80, San Juan Capistrano, Calif. 92675

[21] Appl. No.: 213,230

[22] Filed: Mar. 15, 1994

[51] Int. Cl.[6] ..... A62C 25/00

[52] U.S. Cl. ..... 239/722; 239/198; 239/273; 169/52; 137/355.12; 137/355.17; 242/388.6; 242/400.1; 248/90; 417/234

[58] Field of Search ..... 239/722, 273, 198, 195; 169/51, 52, 13, 30; 137/355.12, 355.28, 355.17, 355.26; 242/388.6, 400.1; 248/80, 90, 89, 129; 417/234, 374

[56] References Cited

U.S. PATENT DOCUMENTS

| | | | |
|---|---|---|---|
| 2,355,035 | 8/1944 | Thicke | 169/52 |
| 2,360,777 | 10/1944 | LaBour | 417/234 |
| 2,520,559 | 8/1950 | Osius | 169/52 |
| 2,884,075 | 4/1959 | Poon | 169/52 |
| 2,918,975 | 12/1959 | Conery et al. | 169/24 |
| 3,736,952 | 6/1973 | Thompson | 137/355.28 |
| 3,913,837 | 10/1975 | Grant | 239/198 |
| 4,238,074 | 12/1980 | Coons | 239/199 |
| 4,671,315 | 6/1987 | Gardner | 137/355.12 |
| 5,154,238 | 10/1992 | Buchan | 169/62 |

*Primary Examiner*—Karen B. Merritt
*Attorney, Agent, or Firm*—Macro-Search Corp.

[57] ABSTRACT

A portable water pumping station is disclosed. A hand-drawn support stand includes wheels, a vertical frame, and a handle that may be used to manually roll the pumping station along the ground. A mounting shelf fixed to the lower portion of the support stand holds a motor-driven water pump. The inlet side of the pump is connected to a suction hose that is either placed into a nearby body of water or connected to a municipal water source. The outlet side of the water pump is connected to one end of a pressure hose. The pressure hose is normally coiled on a storage take-up reel mounted to the frame, and has a nozzle at one end. Additional hose storage frame may be included on the frame for extending the pressure hose if necessary.

4 Claims, 2 Drawing Sheets

PORTABLE PUMPING STATION

FIELD OF THE INVENTION

This invention relates generally to water pumping devices and, more particularly, is directed towards a portable water pumping station.

BACKGROUND OF THE INVENTION

When a brush fire threatens an urban residential or business area, there is often very little that the home or business owners can do to protect their property from fire damage. Garden hoses are usually the only available fire fighting tool, and are clearly inadequate for such service. Moreover, often water pressure in municipal water mains is inadequate during such emergencies. Fire fighting forces are often overwhelmed during such emergencies, and cannot be expected to even try to protect every residential or business structure. Thus little is available to assist such property owners during a fire emergency.

During such a fire emergency, structures located near a water source such as a swimming pool or a lake might be saved if there is a readily available means of delivering water from the source to the area to be protected. U.S. Pat. No. 4,671,3 15, issued to Gardner on Jun. 9, 1987, discloses a device suitable for this purpose. However, such a device provides only limited hose storage capability, and thus it provides a relatively small range of protection. Further, such a device is not easily transported by vehicle since it is somewhat bulky in design. Such a device is well suited for transportation in a pick-up truck, or the like, but is not otherwise easily transported.

Clearly, then, there is a need for a portable pumping station that provides high capacity water pumping capability at locations near a water source. Such a needed device would be able to reach difficult-to-reach locations, and would not require electrical power to operate. Such a needed device would conveniently hold multiple water hoses for providing extended range. Further, such a needed device could be readily mounted to a vehicle trailer hitch, or the like, for facilitating transport thereof. The present invention fulfills these needs and provides further related advantages.

SUMMARY OF THE INVENTION

The present invention is a portable water pumping station. An upright hand-drawn support stand includes wheels, a vertical frame, and a handle that may be used to manually roll the pumping station over terrain. A mounting shelf fixed to the lower portion of the support stand holds a motor-driven water pump. The inlet side of the pump is connected to a suction hose that is either placed into an available body of water or connected to a municipal water source. This suction hose is stored coiled over a J-shaped utility arm mounted to the frame. The outlet side of the water pump is connected to one end of a pressure hose. The pressure hose is normally coiled on a storage take-up reel mounted to the frame, and has a nozzle at one end. The hose storage reel may be extended for increased hose storage capacity.

The present invention is a portable pumping station that provides high capacity water pumping capability at locations near a water source. The primary uses of the instant invention are as follows. First, it may be used for fire suppression. In this application a pool, pond, lake, or other body of water may be used. If a fire hydrant or storage tank is available, it also may be used for drawing water. A second use is for dewatering or draining such as may be required after heavy rains or flooding. Examples include flooded basements, ditches, and low lying areas. In this case a larger diameter hose may be used for direct pumping to a tank, truck, or other discharge receiver. The third use of the present invention is as a general utility wash-down facility for high volume and pressure flooding of apparatus or surfaces for general cleaning. This use can vary from vehicle applications, both marine and land, to homes, buildings and other structures requiring flood wash-down. In all cases the high portability and extremely simple and fast hook-up and use of the invention are advantages.

The invention is a complete utility, self-contained package for standard or emergency use. Its vertical orientation allows for a relatively small footprint for storage in small spaces. All hoses use quick-connect type couplers to facilitate fast interconnection. The device may be positioned at difficult-to-reach locations, and does not require an electrical power source to operate. The device conveniently holds multiple hoses that may be used in series if additional reach or length is necessary. The frame is adapted to hold two standard rack hose mounts for accordion-style storage of fire hose. A third rack may be added in place of the hose reel. The reel facilitates rewinding of the hose so that it is preferred for frequent use situations. However, the pin rack hose mount facilitates very fast, non-kinked emergency deployment. The pin racks are pivoted so that they can be directed at the point of use for faster and safer use. Further, the present device is readily mounted to a vehicle trailer hitch, or the like, for facilitating transport thereof. Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
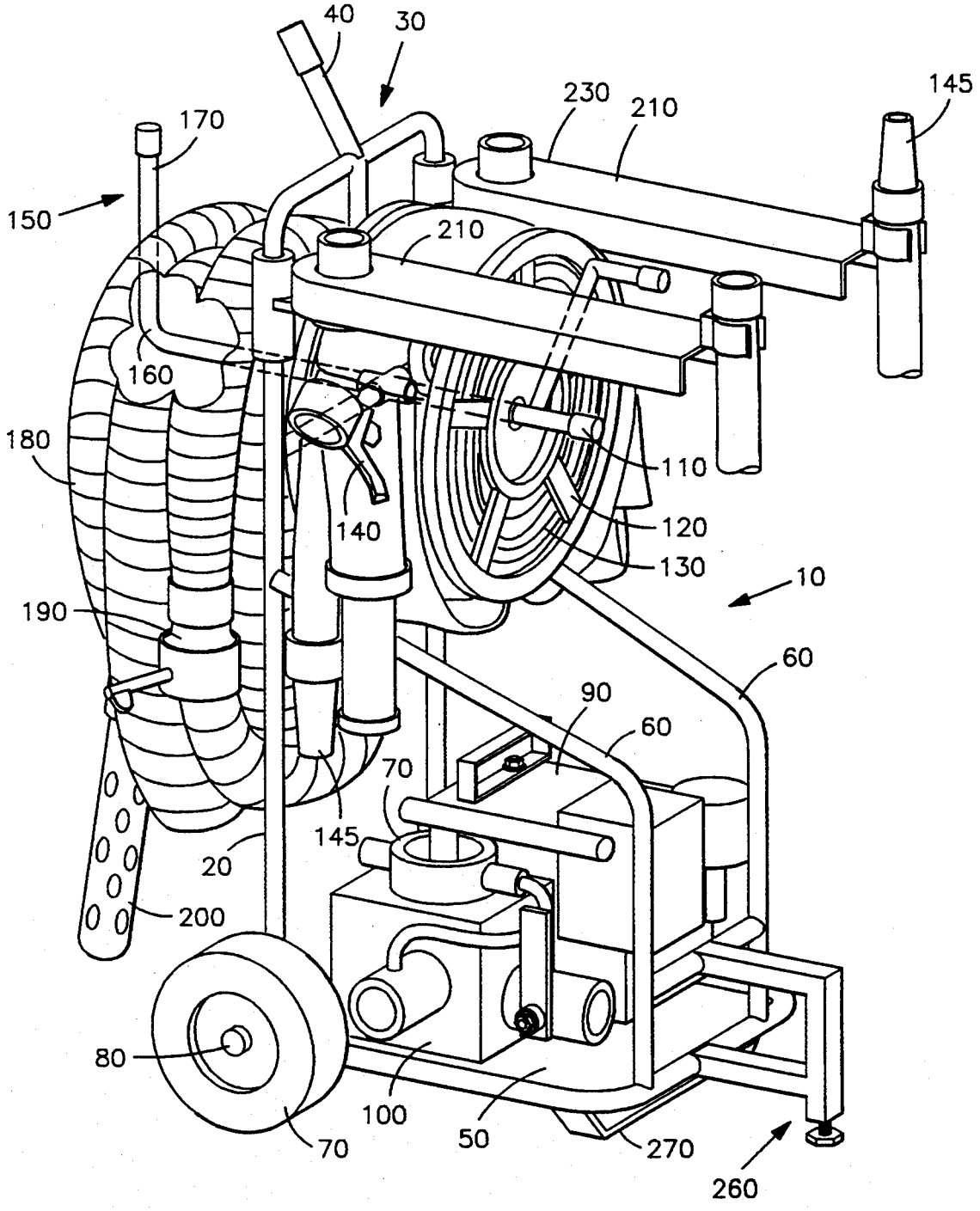
FIG. 1 is a perspective illustration of a portable pumping station, showing a support stand that supports a water pump, a suction hose, and at least one pressure hose.
Figure 2A:
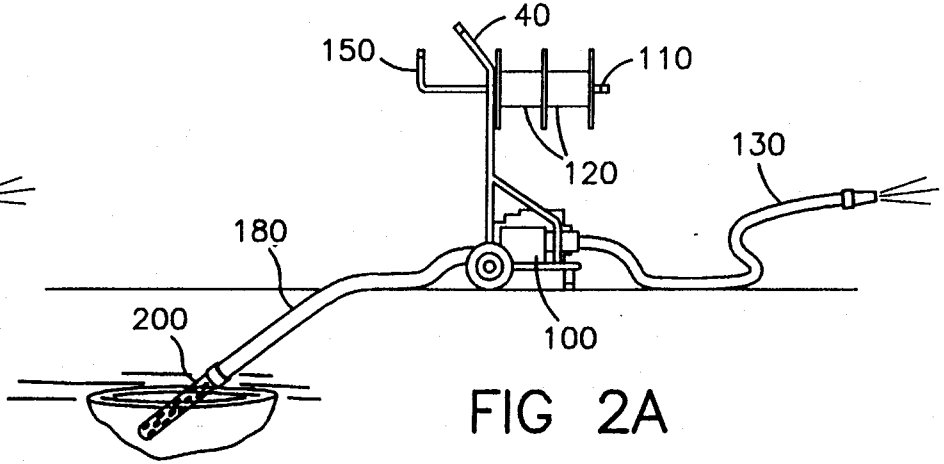
FIG. 2A is a right-side elevational view of the invention, illustrating the device as used with a source body of water.
Figure 2:
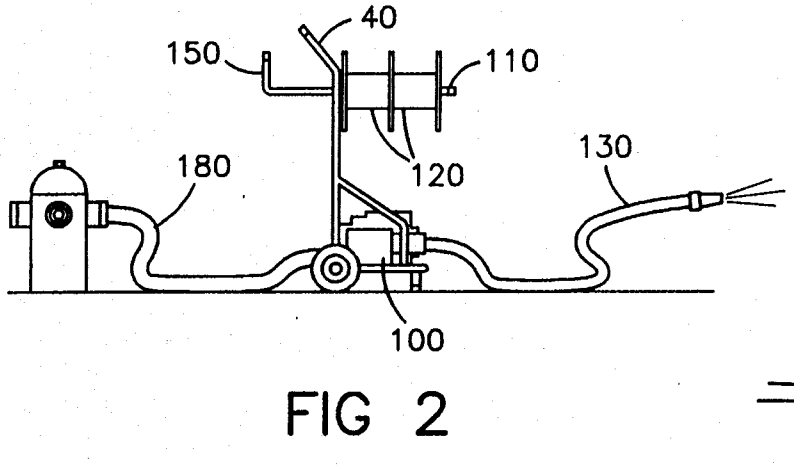
FIG. 2 is a right-side elevational view of the invention, illustrating the device as used with a municipal water source.

FIGS. 1 and 2 show a portable pumping station. A support stand 10 has a vertical frame portion 20 with an upper cross member 30 that includes a handle 40 extending therefrom. The support stand 10 is manufactured from a rigid material, such as metal tubing. The vertical frame portion 20 further includes a horizontal mounting shelf 50 cantilevered to one side of the frame 20 and supported by a pair of spaced apart dogleg-shaped cross braces 60. The cross braces 60 interconnect the vertical frame 20 and the mounting shelf 50. The stand 10 further includes a pair of wheels 70 rotatably mounted on opposing ends of an axle 80 that is fixed to the vertical frame 20. The wheels 70 rollably support the pumping station for hand-drawn movement on a supporting surface. Additionally, a front foot stabilizing bar 270 extends downwardly from the mounting shelf 50 for providing stability to the frame 20, in cooperation with the wheels 70, when the frame 20 is in an upright orientation.

A prime mover 90 is rotationally coupled to a liquid pump 100, and both the prime mover 90 and pump 100 are fixed to the mounting shelf 50. The prime mover 90 may be an electric motor, a gasoline-powered motor, or the like. A gasoline-powered motor is preferred, since the pumping station may then be used without requiring the availability of electrical power.

A support axle 110 is fixed to the frame 20 above the prime mover 90 and pump 100. The support axle 110 extends horizontally from the frame 20 for rotationally supporting a hose take-up reel 120 that is engaged thereon. The reel 120 supports at least one pressure hose 130 in coiled storage. A pump discharge fitting coupling device 140 is included at one end of the at least one pressure hose 130 (FIG. 1), and a hose nozzle 145 is included at the other end of the at least one pressure hose 130. In one embodiment of the invention, the support axle 110 rotationally supports a second hose take-up reel 120 (FIG. 2).

A support arm 150 is fixed to the frame 20 and extends colinearly with the support axle 110. The support arm 150 includes a first horizontal portion 160, and a second portion 170 that extends vertically from a distal end of the first portion 160. The support arm 150 holds a suction hose 180 that includes, at one end, a pump inlet fitting coupling device 190 and, at the other end, a suction device 200. The suction hose 180 cannot be tightly wound on a reel, and therefore it is stored coiled on the support arm 150. The support arm 150 is also useful for holding buckets, other hoses, and the like.

Figure 3:
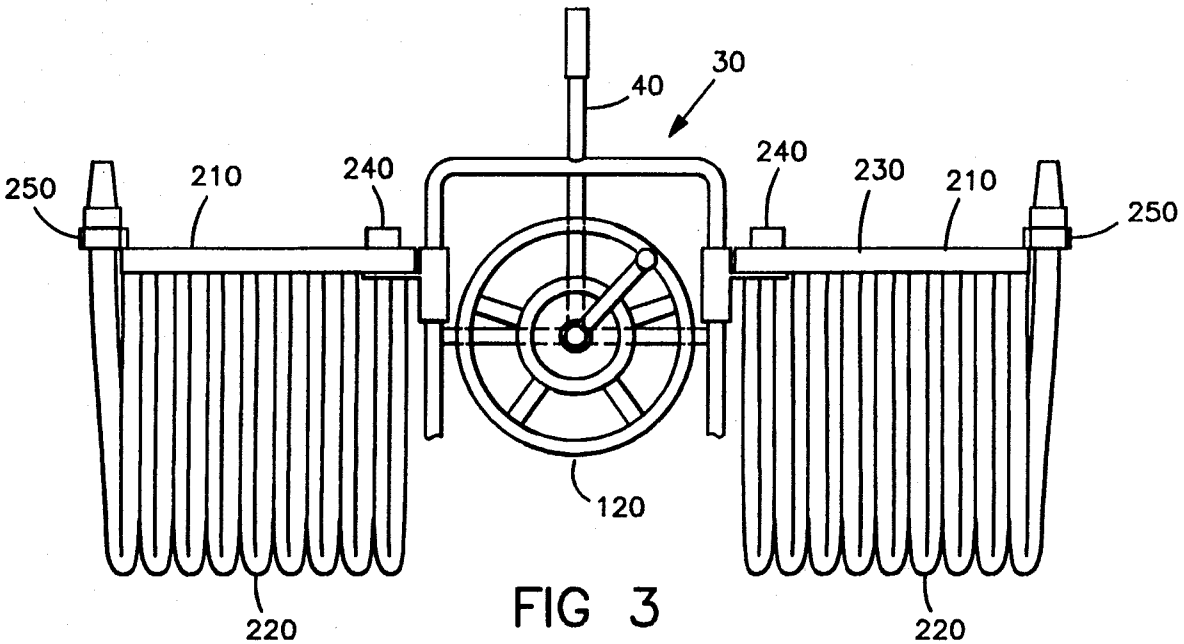
FIG. 3 is a partial front elevational view of the invention, illustrating a hose take-up reel and a pair of adjacent hose storage frames.

At least one hose storage frame 210 may be further included with accordion-folded pressure hoses 220 mounted therein (FIG. 3). The hose storage frame 210 includes a pivotal mount 230 on one end thereof, and the support stand 10 includes at least one pivotal mount 240 holder for pivotal engagement of the hose storage frame 210. The other end of the hose storage frame 210 includes a hose nozzle clamping means 250. Further, a hitch device 260 may be included on the stand 10 for mounting the station to a vehicle bumper (not shown), thereby facilitating transport of the station to a desired remote location. The hitch device 260, illustrated in FIG. 1, is positioned into an aperture in the vehicle bumper, and the stand is then pivoted around the hitch device 260 up towards the vehicle and held in place by a suitable auxiliary restraint strap means (not shown).

In operation, as shown in FIGS. 2 and 2A, the pumping station is positioned at a desired location adjacent to a water source. The suction hose 180 is taken from the support arm 150 and interconnected between the water source and the pump 100. The pump inlet fitting coupling device 190 is engaged with an inlet fitting of the pump 100. The water source may be a municipal water supply, an open body of water, such as a lake or swimming pool, or other water source in which case suction device 200 is used. Alternately, a hydrant or other municipal water source may be utilized if available, and in this case any standard coupling device is used in place of suction device 200, and the discharge fitting coupling device 140 is engaged with a pump discharge fitting. As such, with the prime mover 90 driving the pump 100, water is moved from the water source, through the suction and pressure hoses 180,130, to the hose nozzle 145.

While the invention has been described with reference to a preferred embodiment, it is to be clearly understood by those skilled in the art that the invention is not limited thereto. Rather, the scope of the invention is to be interpreted only in conjunction with the appended claims.

What is claimed is:

1. A portable pumping station comprising:

a support stand having a vertical frame portion with an upper cross member including a handle extending therefrom, the vertical frame portion further including a horizontal mounting shelf cantilevered to one side of the frame and supported by a pair of spaced apart dogleg-shaped cross braces interconnecting the vertical frame portion and the mounting shelf, the stand further providing a pair of wheels rotatably mounted on opposing ends of an axle fixed to the vertical frame portion in a position for rollably supporting the station for hand-drawn movement on a supporting surface;

a prime mover rotationally coupled to a liquid pump, the mover and pump fixed to the mounting shelf;

a support axle fixed to the vertical frame portion above the mover and pump and extending horizontally therefrom, for rotationally supporting a hose take-up reel engaged thereon, the reel supporting in coiled storage thereon, at least one pressure hose including at one end thereof, a pump discharge fitting coupling device and at the other end, a hose nozzle; and a support arm fixed to the vertical frame portion and extending colinearly with the support axle, with a first horizontal portion, and further including a second portion extending vertically from a distal end of the first portion, the support arm holding a suction hose including at one end thereof, a pump inlet fitting coupling device, and at the other end, an intake device;

whereby the pumping station is positioned at a desired location adjacent a water source, the suction hose taken from the support arm is interconnected between the water source and the pump with the intake device communicated with the water source and the pump inlet fitting coupling device engaged with an inlet fitting of the pump, the at least one pressure hose being unreeled from the hose take-up reel, the discharge fitting coupling device being engaged with a pump discharge fitting such that with the prime mover driving the pump, water is moved from the water source, through the suction and pressure hoses, to the hose nozzle.

2. The pumping station of claim 1 further including at least one hose storage frame and accordion folded pressure hose mounted therein, the at least one hose storage frame including a pivotal mount on one end thereof, the support stand including at least one pivotal mount holder for pivotal engagement of the at least one hose storage frame, the other end of the at least one storage frame including a hose nozzle clamping means.

3. The pumping station of claim 1 further including a hitch device for mounting the station to a vehicle bumper.

4. The pumping station of claim 1 wherein the support axle rotationally supports a second hose take-up reel and a second coiled pressure hose.

* * * * *